United States Patent [19]

Kubon et al.

[11] Patent Number: 4,940,075

[45] Date of Patent: Jul. 10, 1990

[54] START-UP HEAD FOR HORIZONTALLY CONTINUOUS CASTING

[75] Inventors: Achim Kubon, Neukirchen-Vluyn; Klaus-Peter Ehlert, Moers-Repelen, both of Fed. Rep. of Germany

[73] Assignee: Mannesmann AG, Duesseldorf, Fed. Rep. of Germany

[21] Appl. No.: 328,175

[22] Filed: Mar. 24, 1989

[30] Foreign Application Priority Data

Mar. 24, 1988 [DE] Fed. Rep. of Germany ..... 3810304

[51] Int. Cl.[5] ..... B22D 11/08

[52] U.S. Cl. ..... 164/446; 164/426

[58] Field of Search ..... 164/446, 445, 426, 425

[56] References Cited

U.S. PATENT DOCUMENTS 3,602,290 8/1971 Schmidt et al. ..... 164/446
3,627,017 12/1971 Knell et al. ..... 164/426 X
4,381,030 4/1983 Knell ..... 164/446

FOREIGN PATENT DOCUMENTS 0070493 1/1983 European Pat. Off. ..... 164/446
1503487 3/1978 United Kingdom ..... 164/425

*Primary Examiner*—Richard K. Seidel
*Assistant Examiner*—J. Reed Batten, Jr.
*Attorney, Agent, or Firm*—Ralf H. Siegemund

[57] ABSTRACT

Start-up head for continuous casting in the horizontal has a coupling member that will be embedded from three sides in molten metal, the coupling member has a hooklike portion having an undercut portion below a center line of the casting and having a point of curvature inflection, the undercut portion running from that point of inflection towards the center line along a circular path having a center of curvature above a horizontal plane that runs through the center line; a front end of the hooklike portion has a circular contour beginning from a point below the center line at a distance that is about the same distance the point of inflection has from the center line, the circular contour extending to the upper side of the member has a center of curvature above the first mentioned center of curvature but a larger distance from the center line; and the center for uncoupling the member from the casting is situated between the first and second centers of curvature.

1 Claim, 1 Drawing Sheet

START-UP HEAD FOR HORIZONTALLY CONTINUOUS CASTING

BACKGROUND OF THE INVENTION

The present invention relates to continuous casting in the horizontal and more particularly the invention relates to a start-up head for use in cooperation with a mold for continuous casting whereby the start-up head is provided with a coupling and connecting member which will form a positive hooklike connection in contour matching relationship with the beginning portion of the casting itself. The coupling member, however, has to be uncoupled from the casting through tilting whereby the member is provided with a curved undercut on the side facing the casting with a corresponding curvature on the opposite side.

Starting a machine for continuous casting usually needs a particular start-up head which is, so to speak, in the front part of the casting. The casting start-up head has a cross section which corresponds to the cross section of the mold. Hence, prior to casting the mold is in effect closed by this head. As the mold is filled with liquid metal such as molten steel, the material flows around the coupling member of the start-up head and will provide, on solidification, a form and contour matching connection between the start-up head on one hand as a whole and the casting as a whole on the other hand. In order to reuse the start-up head its coupling member is to be configured that it can in fact be separated from the beginning portion of the casting e.g. for tilting.

German pat. No. 19 21 312 discloses and describes a start-up head for vertical continuous casting wherein the coupling member has a convex hooklike configuration. The transition from coupling member to that part of the start-up head which provides closing and sealing of the mold prior to casting is configured so that its undercut portion is only of very minimal dimensions. Actually that particular part could be termed arc-shaped so that there is a danger that the head separates from the front end of the casting, even on minimal tilting.

Closer to the state of the art which forms the point of departure of the present invention but still referring to vertical casting is the European pat. No. 70 493. The head disclosed in this patent has a hooklike coupling member which on extracting the casting from the mold makes sure that undesired de-coupling in the secondary cooling zone will be avoided. Here it has to be considered that the guiding equipment in the secondary cooling zone is sparsely distributed or not present at all. This patent does disclose a safe and automatic decoupling of the start-up head from the casting at a desired location where downstream decoupling is in effect desired. This known head however is suitable only for the usual curved casting equipment because forces are transmitted on the casting only in the direction of extraction so that there must be retained a strictly colinear relationship.

SUMMARY OF THE INVENTION

It is an object of the present invention to provide a new and improved start-up head of the kind to which the introduction refers to and having the known advantages to be retained without however providing additional expenditure but avoiding the problems mentioning above with particular emphasis on the possibility of using and re-using the head in a horizontal casting machine.

Before describing the invention it should be noted that in the case of horizontal casting the extraction of the casting from the mold is not strictly uniform and continuous process, but intermittently tension and compression forces are provided whereby in the case of a change in direction, holding periods are interposed. This means that the reusable start-up heads known from vertical casting are simply not applicable to horizontal casting since on retraction they would be forced out of the connection with the casting and may even damage the mold! In other words the known start-up heads cannot cope with the intermittency of force transmission that is inherent in the continuous casting process in the horizontal.

In accordance with the preferred embodiment of the present invention it is suggested to provide the coupling member of a start-up head for continuous casting in the horizontal, with a hooklike portion such that the downward facing undercut side is situated under the center line of the casting. The surface areas of that hook are critical. First there is a point of curvature inflection from which the undercut portion extends towards the center line of the head (which is the center line of the mold and of the casting), in circle that thus extends the center of the casting; the center of that circle is situated above the center line of casting (and above a horizontal plane through that line). The opposite or inner end side of this hooklike member is of calotte configuration which has a circular contour from a point up, but being spaced from the center line of the casting will at least approximately the same distance the point of inflection has from that line; the calotte extends up to the upper side of the head and on a circle (of the calotte) having a center point of curvature situated in the same transverse plane (vertical alignment) as the earlier mentioned center of curvature but being further spaced from the center line of the head and casting i.e. being closer to the upper side of the strand and of the head than the center of the undercut portion. The pivoting that is necessary for separating the casting from the head, occurs in a particular direction around a center that is situated still in the same transverse plane of the casting as mentioned and particularly in between the two centers of curvatures as defined.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
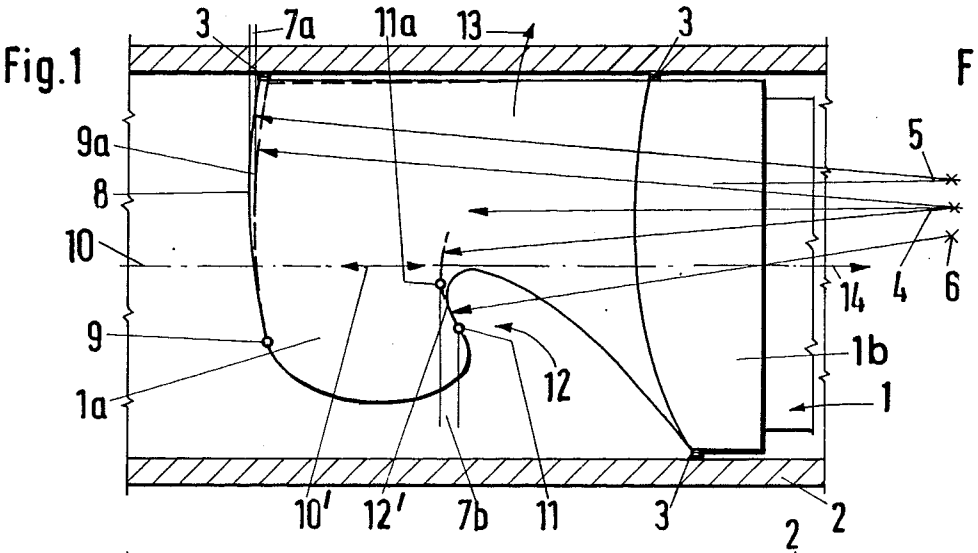
FIG. 1 is a longitudinal cross section section through a start-up head in accordance with the invention for practicing the preferred embodiment thereof, the plane of section running through the center line of casing.
Figure 2:
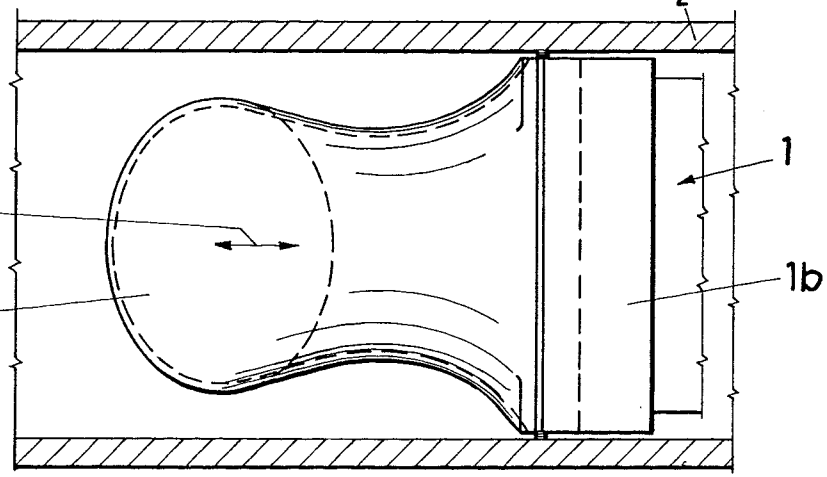
FIG. 2 is a top view of what is shown in FIG. 1.

Proceeding now to the detailed description of the drawings, FIG. 1 and the others show a start-up head 1 having a front part 1*b* which seals the mold 2 for continuous casting during start-up procedure. The start-up head 1 has an inwardly extending hooklike coupling member 1*a*. The start-up head 1 has a position in and prior to the beginning of casting as shown in FIGS. 1 and 2. The right hand portion 1*b* is completely occupied by the start-up head whereas the hooklike left hand portion 1*a* in the drawing will be enveloped by flowing around liquid metal as soon as such metal is poured into the mold 2 (from the left). The sealing of head part 1*b* is provided through edge elements 3.

As soon as molten metal enters the mold it will embed the hooklike left hand portion 1*a* of the start-up head. In order to make sure that the connection remains positive even though the casting is carried out intermittently i.e. even though the casting start-up head will move relatively to the mold in both horizontal directions. (see double arrow line 10' in FIGS. 1 and 2). Thus, the head will pull on but also push against the casting. Therefore one must make sure that the casting will not disengage from the start-up head during this procedure while on the other hand, once the start-up head has fulfilled the function and is situated downstream in the line of casting, the head can be removed with relative ease. For this coupling member 1*a* is defined through certain particular features of curvature.

Reference numeral 14 denotes the direction of casting extraction. That part of the hook 1*a* which faces in the direction 14 provides an undercut portion 12. Reference numeral 11 denotes geometrically a point of inflection within that undercut portion. From that point 11 on the hook has a portion 12' which runs on a circle having a point of original center 6. As can be seen this point 6 is situated above the horizontal plane that runs through the center line 10 of the casting and of the head. On the opposite sides, coupling member 1*a* is likewise bound by a circle having a center 5 of curvature. This point is likewise situated above the horizontal plane through center line 10. Moreover, center 5 is spaced from that plane by a distance larger than the spacing between 6 and this aforementioned center plane.

To the left of FIGS. 1 and 2 which is the thrust side of the casting and the start-up portion thereof an area 8 will form on filling the mold with molten metal which the start-up can be forced in the case of a retraction cycle which is of course the direction of pushing opposite the direction of pulling and extraction arrow 14. Furthermore this calotte shaped front end 8 of the material begins its circular configuration at a point 9 which is spaced from center line 10 by a distance that is about the same distance inflection point 11 has from that line 10, or from a horizontal plane running through that line 10. Owing to this particular configuration there will be no forces which may tend to separate the start-up head from the castings.

Later the start-up head will be separated from the casting through a pivot motion in direction of arrow 13, about a point 4 and center which is likewise situated above the plane through 10 but center 4 is situated in between the two points 5 and 6. This particular geometry makes sure that on pivoting the head 1 its coupling member 1*a* will lift off the surrounding surfaces of the casting without any problem.

Figure 3:
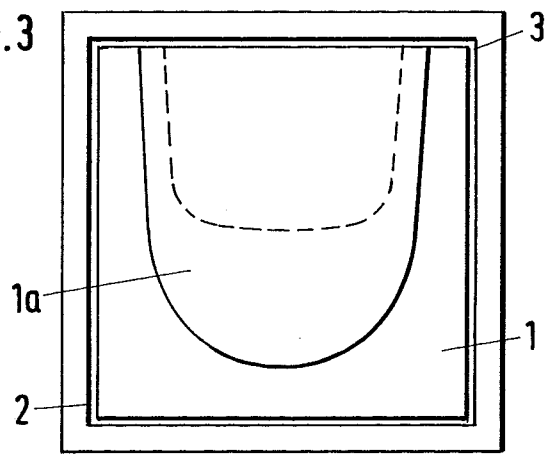
FIG. 3 is a front view of the start-up head shown in FIGS. 1 and 2.
Figure 4:
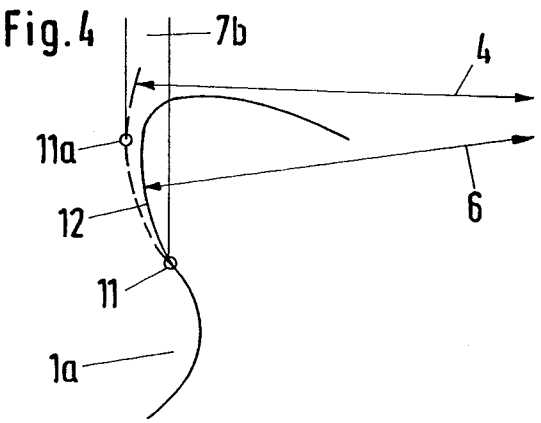
FIG. 4 shows a certain portion of the start-up head shown in FIG. 1 on an enlarged scale in order to explain relevant geometry involved.

FIGS. 1 and 4 show specifically the requirement and arrangement for the centers of curvatures as far as the start-up head and bounding surfaces are concerned, specifically in relation to the center for the pivoting for the head for purposes of separation. FIG. 4 shows that the undercut portion 12 runs indeed on a circle around the point 6. FIG. 1 also shown that the three centers 4,5 and 6 are vertically aligned; they are situated in a common plane that extends transversely to the center line 10 of casting, of the mold and of the start-up head.

Now, on pivoting the head about the point 4 for purposes of separation it is of course assumed that the mold 2 has receded far from the arrangement. As the head pivots about point 4 the point 11 of inflection will run on the dash-dot line 11*a* owing to this pivoting for removing the head is removed from the casting. Considering point 11 as point of reference along a different radius as compared with the radius of curvature of the undercut portion in the zone or area 12. This is the specific instrumentality so that the hook shaped side of the head as primarily determined by this point of deflection 11 of the surrounding metal will not interfere with the pivot motion when occurring about the pivot point 4 on that side of the coupling member. The length of the transverse motion which, as far as point 11 is concerned runs along 11*a*, is denoted by reference numeral 7*b*.

Analogously the other (axial end) side of the hook as seen in axial direction and being generally denoted with reference numeral 8, will be removed from the metal on pivoting for exactly the same reason. Critical here is the point 9 which runs on a track in direction of arrow 13. That motion is drawn by dash-dot lines in the FIG. Here one can say that in fact the point 9 owing to the particular pivot motion center 4 will lift off its counter surface and on 9*a* has in fact receded from that counter surface by the spacing 7*a*. This effect obtains particularly because the surface running through a circle at 8 and with the center 5, will be moved axially on uncoupling around the center 4 and this axial separation makes sure that the two calotte shaped surfaces repectively of the start-up head and the casting will in fact lift off each other without interference when pivoting obtains about this different point 4.

The invention is not limited to the embodiments described above but all changes and modifications thereof, not constituting departures from the spirit and scope of the invention, are intended to be included.

We claim:

1. Start-up head for continuous casting in a horizontal direction, the head having a coupling member that will be embedded from three sides in molten metal which forms a casting the coupling member having a hooklike portion, the improvement comprising the hooklike portion having an undercut portion below the center line of the head and having a point of curvature inflection, the undercut portion running from that point of inflection towards said center line along a circular path having a first center (6) of curvature above a horizontal plane that runs through the center line;

a front end of the hookline portion has a circular contour beginning from a point below the center line at a distance that is about the same distance the point of inflection has from the center line, the circular contour extending to the upper side of the member has also a second center (5) of curvature above said first center of curvature but at a larger distance from the center line; and a center for uncoupling the member from the casting being situated between said first (6) and second (5) centers of curvature.

* * * * *